US005111854A

United States Patent [19]

Begley et al.

[11] Patent Number: 5,111,854

[45] Date of Patent: May 12, 1992

[54] PARTICLE MOVEMENT SYSTEM WITH CONTROL OF DUST

[75] Inventors: Brendan J. Begley, Bound Brook; Subrahmanyam Cheruvu, Mercerville, both of N.J.

[73] Assignee: Mobil Oil Corporation, Fairfax, Va.

[21] Appl. No.: 662,660

[22] Filed: Mar. 1, 1991

[51] Int. Cl.[5] ..... B65B 3/04

[52] U.S. Cl. ..... 141/65; 141/312; 141/374; 141/93; 220/254; 220/229

[58] Field of Search ..... 141/65, 67, 329, 330, 141/312, 374, 368, 93; 220/229, 377, 319-321, 254, 327, 90.4, 90.2

[56] References Cited

U.S. PATENT DOCUMENTS

| | | | |
|---|---|---|---|
| 571,708 | 11/1896 | Thompson | 220/229 X |
| 3,478,922 | 11/1969 | Mole | 220/229 X |
| 3,897,884 | 8/1975 | Lankenau | 220/320 |
| 4,311,492 | 1/1982 | Eltvedt | 220/377 |
| 4,454,944 | 6/1984 | Shillington et al. | 220/229 X |
| 4,721,137 | 1/1988 | Muller | 141/65 |
| 4,832,227 | 5/1989 | Hoffman | 220/327 |
| 4,948,009 | 8/1990 | Sawatani . | |

FOREIGN PATENT DOCUMENTS

| | | | |
|---|---|---|---|
| 526752 | 6/1956 | Canada | 141/65 |
| 2820566 | 11/1979 | Fed. Rep. of Germany | 220/229 |

*Primary Examiner*—Ernest G. Cusick
*Attorney, Agent, or Firm*—Alexander J. McKillop; Charles J. Speciale

[57] ABSTRACT

A system for removing particulate material from a drum wherein the drum lid is replaced by a lid which is specially designed for this service. This new lid has at least a portion which is transparent so the operator can see into the drum and determine when and if it is empty. It also has a resilient portion which includes radial slits emanating from a predetermined point to produce an iris through which a wand can be inserted. The wand is operatively connected to a vacuum system so that the operator can insert the wand into the drum through the iris, and have the iris conform to the wand sufficiently that the vacuum being pulled through the wand sucks the particles out of the drum.

16 Claims, 2 Drawing Sheets

PARTICLE MOVEMENT SYSTEM WITH CONTROL OF DUST

BACKGROUND OF THE INVENTION

1. Field of the Invention

This invention is directed to the technology of transfer of solid particulate materials. It more particularly relates to means for transferring particulate matter from a container while minimizing the emission of dust to the surrounding atmosphere.

2. Description of Related Art

In industry, it is common to require the transfer of particulate material, especially powdered material, from drums or other suitable shipping containers, into an operating system designed to make use of the particulate material. In the past, this was accomplished by simply turning the drum over and thereby emptying its contents into a suitable hopper or the like. Of course this caused the escape of substantial quantities of the contained particulate material as a dust which contaminated the surrounding atmosphere and was at least potentially injurious to the health of the workers in the vicinity.

In more recent times, it was, and still is, also known to transfer the particulate contents of a shipping container by simply removing the lid thereof, and vacuuming out the contents directly into the operating system being fed. This is inherently a cleaner operation than simply just pouring the drum contents into an open hopper.

In the prior process of vacuuming out the contents of the shipping drums, it was and is necessary for the drum lid to be off so that the worker who is doing the vacuuming can see into the drum to insure that all of the particulate contents thereof has been sucked out, even of the lower corners of the drum. Additionally, for a vacuum system to work, there must be means to let air into the drum to fluidize the particulate contents thereof and allow the thus fluidized particles to be lifted out of the container. Therefore vacuuming cannot be done in a sealed system, or even with a closed drum lid.

In addition to the presentation of a clean-up problem, this type of operation also presents a serious health problem to the workers charged with the responsibility of emptying the drums. Further, the dust is also liable to get into machinery and cause all sorts of maintenance problems.

In the past, this problem has sometimes been attacked by carrying out the transfer in a sealed room, a so-called "dust room", or by using the services of a large hood with special ventilation facilities. Personnel who operate such a facility need to wear protective clothing and to utilize breathing apparatus in order to minimize their contamination from constant, or even intermittent, contact with the dust. Obviously, this makes for a difficult and costly operation.

SUMMARY OF THE INVENTION

It is therefore an important object of this invention to provide a novel means of transferring particulate, especially powdered, matter from a sealed container thereof into a system adapted to utilize it.

It is another object of this invention to provide a means for emptying a container of powdery material while minimizing escape of such material to the surrounding atmosphere.

It is a further object of this invention to provide means of accomplishing these above objectives while enabling an operator to see what is happening in the process.

Other and additional objects will become apparent from a consideration of this entire specification, including the claims appended hereto, and the drawing which is an integral part hereof.

In accord with and fulfilling these objects, one aspect of this invention comprises a novel lid for a container, which container is adapted to hold particulate, especially powdered, material. This lid is of the same overall size and shape as a conventional lid for this same container but has an area which comprises an iris which is made of a substantially flexible, suitably resilient rubbery, material which has been radially slitted about a predetermined point. The number of radial slits is sufficient to allow the insertion therethrough of a wand, to be described below. The length of the slits is sufficient to relatively tightly accommodate the wand. After the wand is inserted, the flaps of the iris, that is the areas between the radial slits, should press rather tightly against the wand while allowing some relatively small amount of open space between them in the areas of the slits.

Suitably the resilient material comprising the iris either makes up the entire novel lid of this invention, or it may comprise only a portion of the novel container lid, the remainder of which may be metal or plastic or any other conventional material which is known for this use. The usual portions of a container lid, such as the means to affix the lid to the container, are included in the lid of this invention in the conventional manner and form no particular part of this invention.

BRIEF DESCRIPTION OF THE DRAWING AND DESCRIPTION OF THE PREFERRED EMBODIMENT OF THE INVENTION IN THE DRAWING

DETAILED DESCRIPTION OF PREFERRED EMBODIMENTS OF THIS INVENTION

Figure 1:
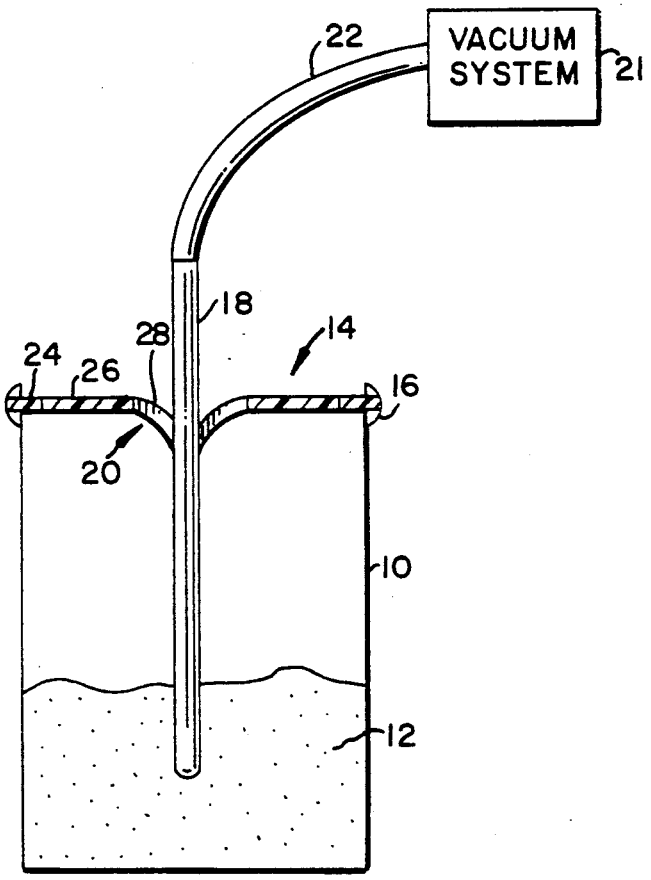
FIG. 1 is an elevation in section of a container and lid therefore according to this invention.

The iris for use in this invention is made by providing radial slits in the resilient portion of the lid about a predetermined point as aforesaid. Its purpose is to allow the insertion of a wand of a vacuum system through the lid into the interior of the container which houses the particulate material being transferred.

The iris serves several additional purposes. As the wand is inserted through the iris, it spreads the resilient material and bends the flaps thereof into the container whereby causing the flaps to press against the wand and to form a partial seal between the wand and both the external atmosphere as well as the contents of the container. This serves to minimize the contact between the contents of the container and the surrounding atmosphere and tends to keep the container contents inside the container rather than allowing such to escape and contaminate the surrounding atmosphere.

As the wand is inserted through the iris, and the flaps are depressed into the container, the slit portions become spread to accommodate the bending of the flaps.

Although the radial slits in resilient material of the closed iris effectively seal the iris and separate the contents of the container from the surrounding atmosphere. as the wand is inserted through the iris, small gaps are created between the flaps.

The size of these gaps will be a function of the diametral size of the wand, and the number of radial slits, and therefore the number of flaps, which make up the iris. Thus, it will be apparent that as few as two (2) radially slits, extending at an angle of 180° from each other about the predetermined center point of the iris, will be sufficient to form the iris. However, the insertion of a wand through such a structure will cause rather large gaps to be formed where the slits were. If the wand has a large diameter, this will exacerbate the size of the gaps.

Therefore, although an iris formed of two opposed radial slits is considered to be within the scope of this invention, a preferred aspect of this invention is to provide a multiplicity, that is more than two (2), of slits to form the iris of this invention. As many as six, eight or ten radial slits can work well.

It should be understood that as the number of radial slits forming the iris is increased, the size of the gaps, between the flaps thereof, which are formed upon the insertion of the wand is decreased. The existence of these gaps is important to the use to which the lid of this invention is to be put. Making the total gap area too small defeats one of the important purposes of the iris, which is to allow air from the surrounding atmosphere to be pulled into the container in an amount sufficient to fluidize the particulate contents thereof and allow these fluidized contents to be vacuumed out of the container. Therefore, it has been determined that the number of radial slits comprising the iris should preferably not exceed about 16.

It should be understood that the optimal number of slits which comprise the iris is determined to a great extent by the size of the wand. If the wand has a small diameter, the gaps created between the flaps upon insertion of the wand through the iris, will be small because the flaps are more able to conform to the contour of the wand. In this circumstance a small number of slits will be appropriate, for example about 4. As the diameter of the wand increases, a small number of flaps each of which are relatively large in area, are progressively less able to conform to the surface contour of the wand. Thus, as the wand diameter increases, the number of flaps should be increased whereby decreasing their respective individual areas and increasing their ability to conform to the contours of the wand surface. However, it must be remembered not to increase the number of slits (flaps) too much or the area of the gaps will become too small to allow sufficient air to penetrate through the iris into the container as aforesaid.

The wand of the vacuum system has been referred to herein as if it had a circular cross section. This is the most common situation. However, the cross sectional shape or size of the wand is in no way limiting on the practice of this invention. This invention is just as applicable to wands of non-circular cross section, such as for example elliptical, octagonal, or the like.

Similarly, the length of the slits which comprise the iris are a function of the effective diameter of the wand. The shortest the slit length can be itself the effective diameter of the wand because if the slits were any shorter, the wand could not penetrate the iris. Therefore, the slits should be of a length which is somewhat longer than half the effective diameter of the wand.

The length of the slits comprising the iris, relative to the diameter of the wand, is also determinative, along with the number of slits and their thickness as well as the inherent resiliency of the material of the resilient portion of the lid, of how closely the flaps conform to the surface of the wand. For the same resilient material, as the length of the slits increases, relative to the half diameter of the wand, the flaps press less strongly against the wand surface. This effects the seal of the flaps against the wand surface.

If the flaps are too long, while it becomes easier to cause the wand to penetrate the iris, but the seal may become too weak to contain the particulate material in the container and may allow too much air to penetrate the iris into the container. If the flaps are too short, the penetration of the wand through the iris becomes more difficult, and the size and area of the qaps between the flaps may become too small to allow sufficient air to penetrate into the container. It is believed that, for best performance, the length of the slits should be between about 110% to 150% of the effective half diameter, that is the radius, of the wand.

The preferred thickness of the resilient material containing the iris for use in this invention is a function of the inherent resiliency of the material, the effective diameter of the vacuum system wand and the number of slits which comprise the iris. For any given combination of these factors, the thickness of the resilient material will always be determined functionally.

It must not be so thin that the required substantial partial sealing of the wand inside the iris is not accomplished. However, it must not be so thick that the effective resiliency is substantially reduced such that the air penetration is deterred beyond that required to support the imposition of a vacuum on the inside of the container and a relatively free flow of the contained particulate material from the contained under the influence of the imposed vacuum. Thicknesses of the order of about 1 to 5 mm. are expected to be quite suitable for most materials and most wand diameters. The proper thickness should be determined for each combination of resilient material, effective wand diameter, and number and length of slits.

The composition of the resilient material is not a critical variable in the practice of this invention. Substantially any material which is resilient under the conditions of use herein and which is substantially inert to the particulate material being transferred from the container by the practice of this invention will suffice. Exemplary materials include soft or hard rubbers, and may include various known resilient polymeric materials. The specific nature of the resilient material is not a critical aspect of this invention.

The combination of the composition of the resilient material, the length and number of slits forming the iris, the thickness of the resilient material, and the effective diameter of the vacuum wand taken together determine the functionally appropriate parameters for designing the lid to be used in the practice of this invention. In using this invention, after the wand has been inserted through the iris, and the particulate material starts to be vacuumed out of the container, there will come a time when substantially all of the particulate material which is easy to reach has been recovered. At this point in the practice of this invention, it is necessary that it be possible to move the wand from side to side within the container so as to be able to remove particulate material from even the lower corners thereof. Therefore, the wand must not be held in the iris so tightly that this is not possible. This is another preferred functional desiratum which the combination of the parameters of this invention must be assembled to meet. It will be easy to determine this proper combination of the composition of the resilient material, the thickness thereof, and the length and number of slits which can accomplish this preferred operation.

One of the preferred aspects of this invention is to provide a container lid comprising a peripheral portion made up of a relatively rigid material such as a plastic, or the like, which is substantially transparent and is suitably made of a clear plastic material; and a central portion, disposed within this peripheral portion, which comprises the iris which has been previously described. This preferred structure of the container lid of this invention allows the insertion of a vacuum wand through the iris as aforesaid and allows the operator to see the areas within the container that are being vacuumed to insure that substantially all of the particulate contents of the container are sucked out.

It is further within the ambit of this invention to provide a container lid structure which has a resilient portion; a substantially clear portion, which is preferably substantially rigid and may even be transparent; and a structural, relatively rigid, portion, which may be opaque and suitably may be made of metal or plastic. In one embodiment of this aspect of this invention, the three elements thereof are substantially concentric, with the resilient portion containing the iris in the center, the clear portion surrounding the resilient portion, and the rigid, structural portion surrounding the clear portion.

Referring now to the drawing, and particularly to FIG. 1 thereof, a suitable container 10 is shown containing particulate material 12. The container is closed at the top thereof with a lid 14 which is held appropriately tightly to the container by means of a conventional ring clamp 16. The lid has a wand 18 passing through an iris 20 therein into effective contact at one end thereof with the particulate material 12 within the container, and connected at the other end to a suitable vacuum source 21 by means of a conventional hose 22.

Figure 2:
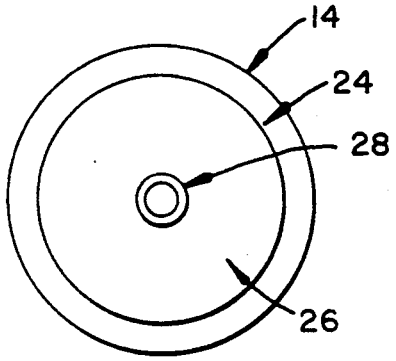
FIG. 2 is a plan view of a preferred embodiment of the container lid of this invention.
Figure 3:
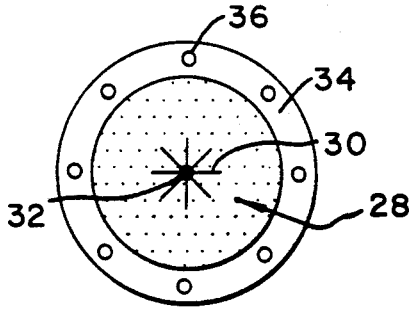
FIG. 3 is an enlarged plan view of a portion of the lid of this invention showing the resilient portion and the iris therein in greater detail.

Referring now to FIG. 2 and 3 of the drawing, there is shown a plan view of one preferred embodiment of the lid of this invention. As shown, the lid comprises a relatively rigid portion 24 about its periphery, a clear portion 26, and a resilient portion 28. In the drawing, these portions are shown to be concentric and circular, which is preferred and is an easy design to build from a construction point of view. The resilient portion 28 comprises multiple slits 30 about a predetermined point 32. There are shown in this embodiment eight (8) slits. The resilient portion 28 is suitably joined to the clear portion 26 by means of a flange 34 and bolts 36.

This invention is suitably practiced by removing the lid of a drum containing particulate material, and replacing that lid with a lid constructed as set forth herein. The relatively stiff wand attached to a vacuum system is thrust through the iris of the lid and the vacuum started. The particulate material is sucked out of the container through the wand and deposited as desired within an operating system or, alternatively, in a larger storage system.

In an actual use of this system of particulate material transfer, 110 pounds of silica was transferred from a drum containing such into a dehydrator using a vacuum system which was at 6 psig. The drum lid was twenty two (22) inches in diameter, had a seventeen (17) inch clear section and a four (4) inch resilient rubber portion attached to the clear section by a bolted flange. During the course of the transfer, substantially no silica escaped from the drum into the surrounding atmosphere.

What is claimed is:

1. A combination of a container containing particulate material therein; a lid, adapted to cover said container, said lid comprising an iris formed of a resilient material said iris comprising multiple slits therein radially disposed about a predetermined point; and a wand inserted into said container through said iris; wherein said iris is so designed and constructed as to permit said wand to be inserted therethrough, and, when said wand is inserted therethrough, to permit unimpeded contact between said particulate material and ambient air.

2. A combination as claimed in claim 1 wherein said resilient material is a rubber.

3. A combination as claimed in claim 1 wherein the resilient material containing said iris comprises a portion of said lid.

4. A combination as claimed in claim 3 wherein said iris is substantially centrally disposed in said lid.

5. A combination as claimed in claim 1 wherein said multiple slits are substantially symmetrically disposed.

6. A combination as claimed in claim 1 wherein said iris comprises 2 to 16 slits.

7. A combination as claimed in claim 1 wherein said iris comprises six slits.

8. A combination as claimed in claim 1 wherein the length of said slits are substantially equal and are about 110 to 150% of the effective radius of said wand.

9. A combination as claimed in claim 1 wherein said resilient material is about 1 to 5 mm thick at least in the vicinity of said iris.

10. A combination as claimed in claim 1 wherein at least a portion of said lid is transparent.

11. A combination as claimed in claim 10 wherein said transparent portion comprises at least a portion of said resilient portion.

12. A system for removing particulate matter from inside a drum containing such which comprises: a drum containing said particulate matter; a lid for said drum at least a portion of said lid comprising a resilient material having an iris which comprises multiple slits disposed about a predetermined point in said resilient materail; a substantially hollow wand extending through said iris, said wand being of a length sufficient to extend at least from said iris to the bottom of said drum, wherein said iris and said wand engage each other in a nonairtight arrangement; and a vacuum system operatively associated with said wand adapted to suck particulate matter out of said drum through said wand.

13. A system as claimed in claim 12 wherein said iris comprises between about 2 and 16 slits, each of which is disposed substantially symmetrically about said point, and each being of a length equal to about 110 to 150% of the effective radius of said wand.

14. A system as claimed in claim 13 wherein all of said slits are substantially the same length.

15. A system as claimed in claim 12 wherein only a portion of said lid comprises said resilient material, and wherein said lid comprises a transparent portion.

16. A system as claimed in claim 15 wherein said resilient portion and said transparent portion are substantially the same portion.

* * * * *